US011783751B1

(12) United States Patent
Lin

(10) Patent No.: US 11,783,751 B1
(45) Date of Patent: Oct. 10, 2023

(54) CHARGING TIME DETERMINATION METHOD, CHARGING TIME DETERMINATION SYSTEM AND DISPLAY DEVICE

(71) Applicant: TCL CHINA STAR OPTOELECTRONICS TECHNOLOGY CO., LTD., Guangdong (CN)

(72) Inventor: Qiqi Lin, Guangdong (CN)

(73) Assignee: TCL China Star Optoelectronics Technology Co., Ltd., Guangdong (CN)

( * ) Notice: Subject to any disclaimer, the term of this patent is extended or adjusted under 35 U.S.C. 154(b) by 0 days.

(21) Appl. No.: 17/935,053

(22) Filed: Sep. 23, 2022

(30) Foreign Application Priority Data

Jul. 27, 2022 (CN) ..... 202210890595.7

(51) Int. Cl.
*G09G 3/20* (2006.01)

(52) U.S. Cl.
CPC ..... *G09G 3/2007* (2013.01); *G09G 3/2096* (2013.01); *G09G 2320/0233* (2013.01); *G09G 2360/16* (2013.01)

(58) Field of Classification Search
None
See application file for complete search history.

(56) References Cited

U.S. PATENT DOCUMENTS 4,651,148 A * 3/1987 Takeda ..... G09G 3/3648 345/94
2020/0227006 A1* 7/2020 Yao ..... G09G 3/006
2023/0178039 A1* 6/2023 Park ..... H01L 27/1214 345/204

* cited by examiner

*Primary Examiner* — Benjamin C Lee
*Assistant Examiner* — Emily J Frank
(74) *Attorney, Agent, or Firm* — PV IP PC; Wei Te Chung; Zhigang Ma

(57) ABSTRACT

An embodiment of the present disclosure is directed to a method of determining a charging time. The method includes: obtaining frame images corresponding to at least three grayscales; determining a luminance and a corresponding charging time of at least one test position in each of the frame images; obtaining a charging time luminance variance curve corresponding to the test position according to the luminance of the at least one test position in each of the frame images and the corresponding charging time; and determining the charging time corresponding to a highest luminance in the charging time brightness change curve as an optimal charging time.

10 Claims, 5 Drawing Sheets

CHARGING TIME DETERMINATION METHOD, CHARGING TIME DETERMINATION SYSTEM AND DISPLAY DEVICE

CROSS REFERENCE TO RELATED APPLICATION

This application claims the priority of Chinese Patent Application No. 202210890595.7, entitled "CHARGING TIME DETERMINATION METHOD, CHARGING TIME DETERMINATION SYSTEM AND DISPLAY DEVICE", filed on Jul. 27, 2022, the disclosure of which is incorporated herein by reference in its entirety.

FIELD OF THE DISCLOSURE

The present disclosure relates to a display technology, and more particularly, to a charging time determination method, a charging time determination system and a display device.

BACKGROUND

At present, users concern an image quality of a display. The display charges the corresponding sub-pixels in each frame image under the control of the scan signal and the data signal, and the charging time directly affects the luminance and chrominance of each sub-pixel. Therefore, evaluating the best charging time of the display product is very important for the image quality display.

Conventionally, the determination of the charging time is mainly achieved by a manual operation. That is, the camera is used to measure the luminance corresponding to different charging times, and then a charging time luminance curve is detected. In this way, the best charging time could be evaluated according to the charging time luminance curve. Due to the need to evaluate the charging time of different points and different grayscales of the display device, it takes a long time to obtain data and errors easily occur. This makes it difficult to determine the optimal charging time. Furthermore, because a batch of films or products only use one version of the parameters, the problem of inter-chip differences caused by different charging times between films cannot be avoided.

SUMMARY

One objective of an embodiment of the present disclosure is to provide a charging time determination method, a charging time determination system and a display device to alleviate the above-mentioned issue of the difficulty of determining the best charging time.

According to an embodiment of the present disclosure, a method of determining a charging time is disclosed. The method comprises: obtaining frame images corresponding to at least three grayscales; determining a luminance and a corresponding charging time of at least one test position in each of the frame images; obtaining a charging time luminance variance curve corresponding to the test position according to the luminance of the at least one test position in each of the frame images and the corresponding charging time; and determining the charging time corresponding to a highest luminance in the charging time brightness change curve as an optimal charging time.

Optionally, the step of obtaining the frame images corresponding to the at least three grayscales comprises: arranging one of the frame images as a reload picture.

Optionally, the step of obtaining the frame images corresponding to the at least three grayscales further comprises: configuring the at least three grayscales to include a low grayscale, a medium grayscale, and a high grayscale; obtaining a reload picture corresponding to the low grayscale; obtaining a reload picture corresponding to the middle grayscale; and obtaining a reload picture corresponding to the high grayscale.

Optionally, the step of determining the brightness of at least one test position in each frame of images and the corresponding charging time comprises: determining luminance of at least three test positions in each frame image and a corresponding charging time; configuring an area where each frame image is located to include a first area, a second area and a third area distributed in sequence; configuring a first test position of the at least three test locations to be located in the first region; configuring a second test position of the at least three test locations to be located in the first region; and configuring a third test position of the at least three test locations to be located in the first region.

Optionally, the step of determining the luminance of the at least one test position in each of the frame images and the corresponding charging time: obtaining a scan signal and a data signal received of each test location in one frame; determining an overlapping time between a pulse of the scan signal and a pulse of the data signal in one frame as the charging time.

Optionally, the step of determining the overlapping time between the pulse of the scan signal and the pulse of the data signal in one frame as the charging time comprises: obtaining a frequency and a phase of the scan signal; obtaining a frequency and a phase of the data signal; under a condition that the frequency of the scan signal and the frequency of the data signal are kept unchanged, changing the phase of the scan signal and/or the frequency of the data signal to adjust the charging time corresponding to the highest luminance in the charging time luminance variation curve to be the optimal charging time.

According to an embodiment of the present disclosure, a charging time determination system is disclosed. The charging time determination system comprises: a display device, configured to display corresponding frame images according to a received grayscale, wherein each of the frame images includes at least one test position; an obtaining module, configured to obtain luminance data corresponding to frame images of at least three grayscales, wherein the luminance data includes a luminance of each test position; a detection module, connected to the display device, configured to capture a corresponding scan signal and a corresponding data signal in the display device; and a processor, electrically connected to the display device, the obtaining module and the detection module, configured to determine a corresponding charging time according to the corresponding scan signal and the corresponding data signal, determine a charging time luminance variance curve according to the luminance of each test potion under the at least three grayscales and the corresponding charging time, and determine a charging time corresponding to a highest luminance in the charging time brightness change curve as an optimal charging time of the display device.

Optionally, the obtaining module is configured to: construct the at least three grayscales including a low grayscale, a medium grayscale, and a high grayscale; obtain a reload picture corresponding to the low grayscale; obtain a reload picture corresponding to the middle grayscale; and obtain a reload picture corresponding to the high grayscale.

Optionally, the processor executes instructions to: determine luminance of at least three test positions in each frame image and the corresponding charging time; configure an area where each frame image is located to include a first area, a second area and a third area distributed in sequence; configure the first one of the at least three test positions to be located in the first area; configure a second one of the at least three test positions to be located in the second area; and configure the third one of the at least three test positions to be located in the third area.

According to an embodiment of the present disclosure, a display device is disclosed. The display device stores an optimal charging time determined by the charging time determination system.

The charging time determination method and the charging time determination according to an embodiment of the present disclosure can obtain the charging time luminance variance curve of the charging time corresponding to the test position through the luminance of the corresponding test position and corresponding charging times corresponding to at least three grayscales, obtain charging time brightness change curves as many as the test positions, and then determine the charging time corresponding to the highest luminance in one or more charging time brightness change curves as the optimal charging time. The process of determining the optimal charging time is simple, efficient and accurate.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION

Figure 1:
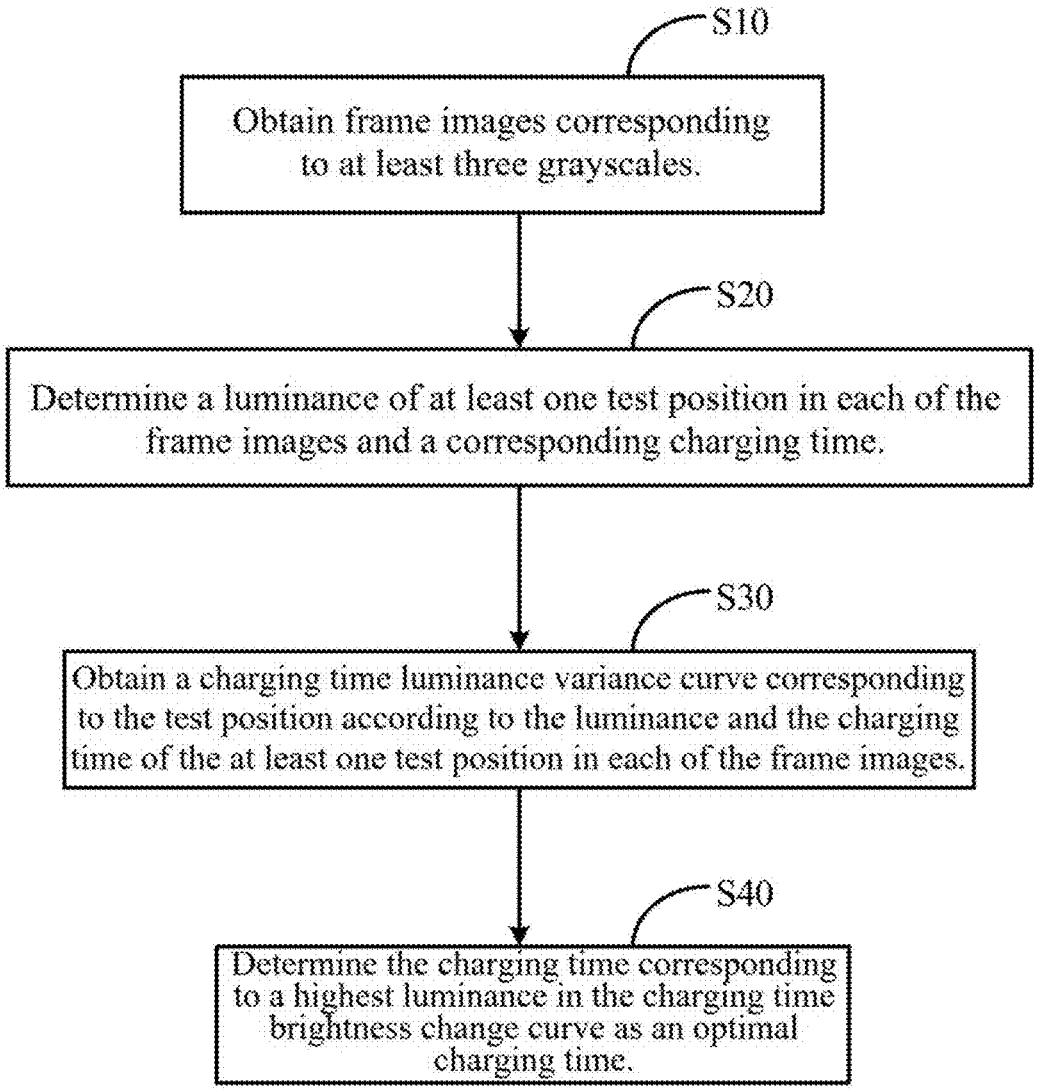
FIG. 1 is a flowchart of a method for determining a charging time according to an embodiment of the present disclosure.

Embodiments of the present application are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present application, and are not to be construed as limiting the scope of the present application.

The present disclosure discloses a charging time determination method based on above-mentioned issue of the difficulty of determining the best charging time. Please refer to FIG. 1. FIG. 1 is a flowchart of a method for determining a charging time according to an embodiment of the present disclosure. The charging time determination method comprises following steps:

Step S10: obtaining frame images corresponding to at least three grayscales. It should be noted that one grayscale corresponds to a frame image. The greater the number of grayscales, the greater the number of corresponding frame images, and the subsequently-obtained charging time luminance variance curve is also more accurate.

Step S20: determining a luminance of at least one test position in each of the frame images and a corresponding charging time. It should be noted that the raw data corresponding to each frame image may include the luminance of each sub-pixel, and one sub-pixel may correspond to one or more test positions. Therefore, the luminance of each test position can be obtained from the raw data. The specific process of determination the charging time will be described later.

Step S30: obtaining a charging time luminance variance curve corresponding to the test position according to the luminance and the charging time of the at least one test position in each of the frame images. It should be noted that each test position can obtain a corresponding luminance and a charging time in each frame image. Therefore, at least three sets of corresponding luminance and charging time can be obtained under at least three grayscales. The charging time is taken as the horizontal axis and the luminance is taken as the vertical axis. In this way, the charging time luminance variance curve of could be obtained by a simulation.

Step S40: determining the charging time corresponding to a highest luminance in the charging time brightness change curve as an optimal charging time. It should be noted that the optimal charging time represents the shortest time to make the voltage of the pixel electrode reach the highest. It can be understood that since the voltage of the pixel electrode is limited by at least one of the liquid crystal capacitor and the storage capacitor, there is a limit to the highest voltage level of the pixel electrode.

Here, the optimal charging time is corresponding to the highest luminance. There may be one or more highest luminance, so the shortest time to reach the highest luminance is the optimal charging time.

According to an embodiment, the method for determining the charging time could obtain the charging time luminance variation curve corresponding to the test position through the luminance and the corresponding charging time of the corresponding test position under at least three gray scales, obtain the charging time luminance variance curves as many as the test positions, and determine the charging time corresponding to the highest luminance in one or more charging time luminance variation curves as the optimal charging time. The process of determining the optimal charging time is simple, efficient and accurate.

The related art evaluates the charging time of the display panel 120 at different points under different grayscales and takes a long time for the data acquisition and is prone to errors. In contrast to the related art, the method for determining the charging time in this embodiment can be automatically executed. That is, there is no need for manual involvements. This not only saves manpower, but also improves the efficiency of determining the optimal charging time.

Here, each test location can be a test point or a test block.

The method for determining the charging time further comprises: obtaining corresponding reload pictures under at least three grayscales; determining the luminance and the corresponding charging time of at least one test location in each reload picture; obtaining the charging time luminance variance curve corresponding to the test position according to the luminance and the corresponding charging time of each test position under at least three grayscales; determining the charging time corresponding to the highest luminance in the charging time luminance variance curve as the optimal charging time.

In the reload picture, one row of pixels is on and another corresponding row of pixels is off. The voltage level of the data signal needs to be continuously switched between a high voltage level and a low voltage level. At this time, the load of the data signal is the heaviest. That is, compared with the ordinary frame image, the optimal charging time obtained under the reload picture is more accurate and the application range is wider. For example, if the optimal charging time is obtained under a light-load picture, then there is a risk that the corresponding sub-pixels may not reach the ideal luminance if the optimal charging time is used under a reload picture.

Figure 2:
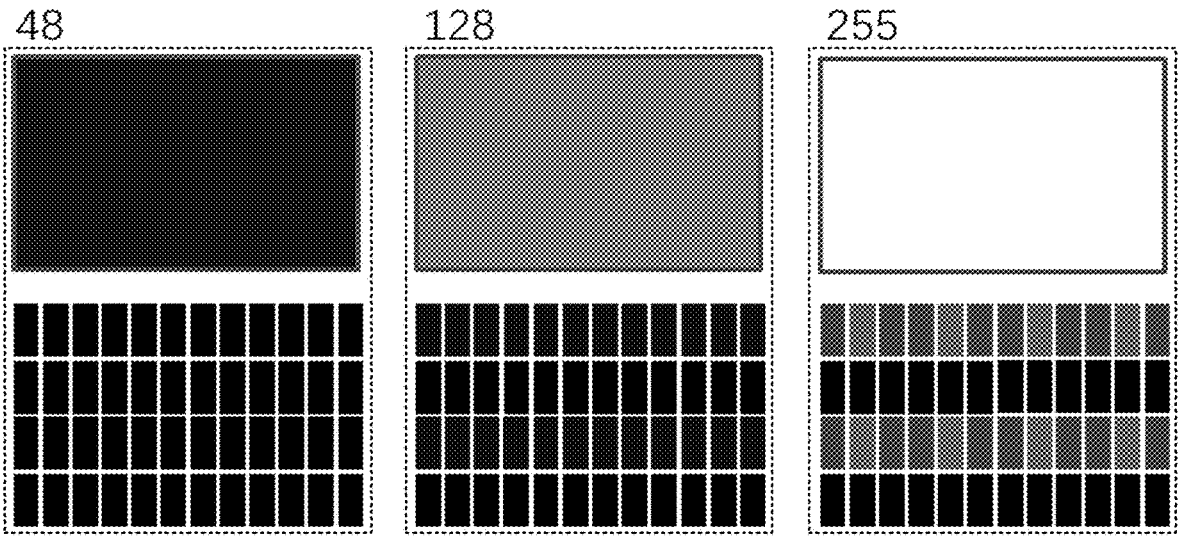
FIG. 2 is a diagram of a frame image under a corresponding grayscale according to an embodiment of the present disclosure.

A specific reload picture is shown in FIG. 2. FIG. 2 shows a reload picture with grayscale numbers of 48, 128, and 255. The upper image in each dashed box is the window image in the corresponding grayscale, and the lower image in each dashed box is the pixel image in the corresponding grayscale.

The method for determining the charging time further comprises: constructing at least three grayscales to include a low grayscale, a medium grayscale, and a high grayscale; obtaining a reload picture corresponding to the low grayscale; obtaining a reload picture corresponding to the mid-grayscale; and obtaining a reload picture corresponding to the high grayscale.

In this embodiment, at least three grayscales are respectively selected from a low grayscale, a medium grayscale, and a high grayscale, which can better take care of the charging time of 0-255 full grayscale, so that the optimal charging time can be used in all grayscales to have a better display luminance.

The method for determining the charging time further comprises: configuring the low grayscale from a grayscale range of 0-48; configuring the medium grayscale from a grayscale range of 49~128; and configuring the high grayscale from a grayscale range of 129~255.

In this embodiment, it is found through a long-term research that the determination of the specific grayscale ranges of the low grayscale, the medium grayscale and the high grayscale is beneficial to improve the compatibility of the optimal charging time under all grayscales.

The method for determining the charging time further includes: configuring the low grayscale as 48; configuring the medium grayscale as 128; and configuring the high grayscale as 255.

After long-term research, in this embodiment, it is found that the optimal charging time obtained by setting the three gray scales as 48, 128, and 255 can minimize the risk of charging errors.

The method for determining the charging time further comprises: obtaining corresponding frame images under at least three grayscales; determining the luminance and the corresponding charging time of at least three test locations in each frame image; obtaining the charging time luminance variance curve corresponding to the test position according to the luminance and the corresponding charging time of each test position under the at least three grayscales; determining the charging time corresponding to the highest luminance in the charging time luminance variance curve as the optimal charging time.

Figure 3:
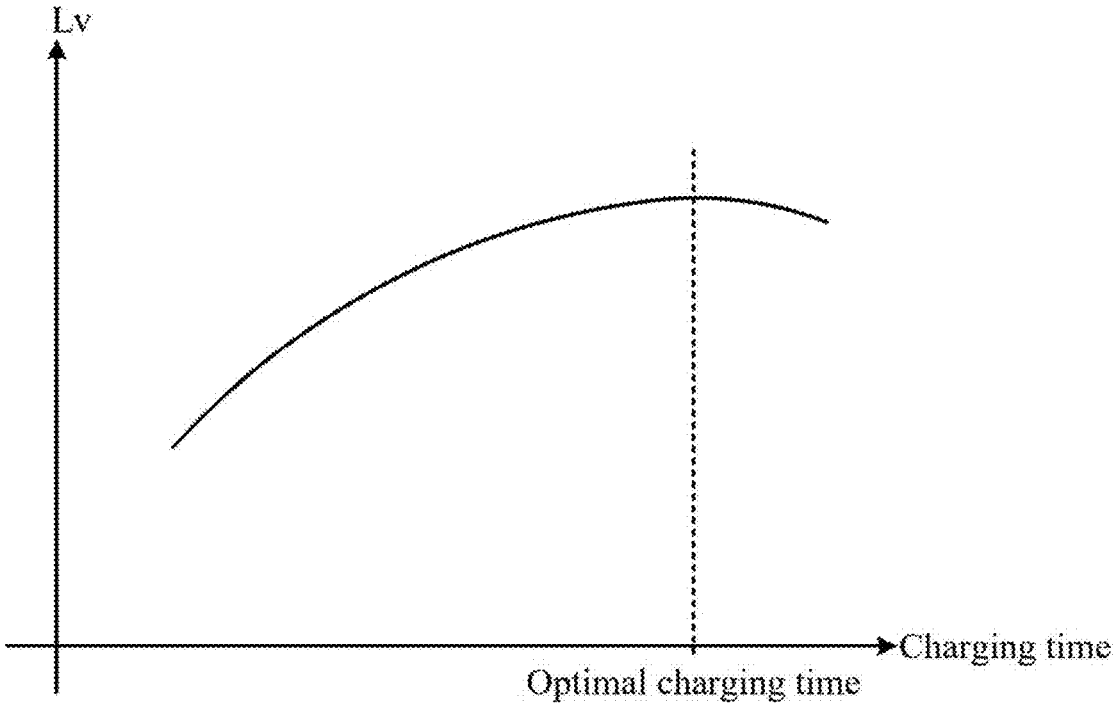
FIG. 3 is a diagram of a charging time luminance variance curve according to an embodiment of the present disclosure.

In this embodiment, the number of test positions of each frame image is increased to at least three. Correspondingly, the number of the obtained charging time luminance variance curves is also increased to at least three. Thus, the highest luminance could be obtained from more different charging time luminance variance curves, and then the charging time corresponding to the highest luminance could be determined as the optimal charging time. In this way, the accuracy of the optimal charging time is improved. Here, the determination of the optimal charging time is shown in FIG. 3. The horizontal axis represents the charging time and the vertical axis represents the luminance (Lv). FIG. 3 depicts only one charging time luminance variance curve. The highest point on the charging time luminance variance curve represents the highest luminance and the corresponding abscissa of the highest point is the best charging time.

The method for determining the charging time further comprises: configuring the region where each frame image is located to include a first region, a second region and a third region distributed in sequence; configuring the first one of at least three test locations to be in the first area; configuring the second one of the at least three test locations to be in the second area; and configuring the third one of the at least three test locations to be in the third area.

In this embodiment, the test positions are selected from different regions, and the obtained optimal charging time can take care of the charging time of each sub-pixel in different positions. Here, the first area, the second area and the third area can be the three areas of the display area from top to bottom in sequence. That is, the three areas are distributed in order along the extension direction of the data line. The optimal charging time could compensate for the voltage drop loss of the data line to a certain extent.

The fourth test position . . . etc. could be selected from one of the first area, the second area, and the third area, as long as they do not overlap with the previously selected test position. In this way, a more accurate optimal charging time could be obtained.

Figure 4:
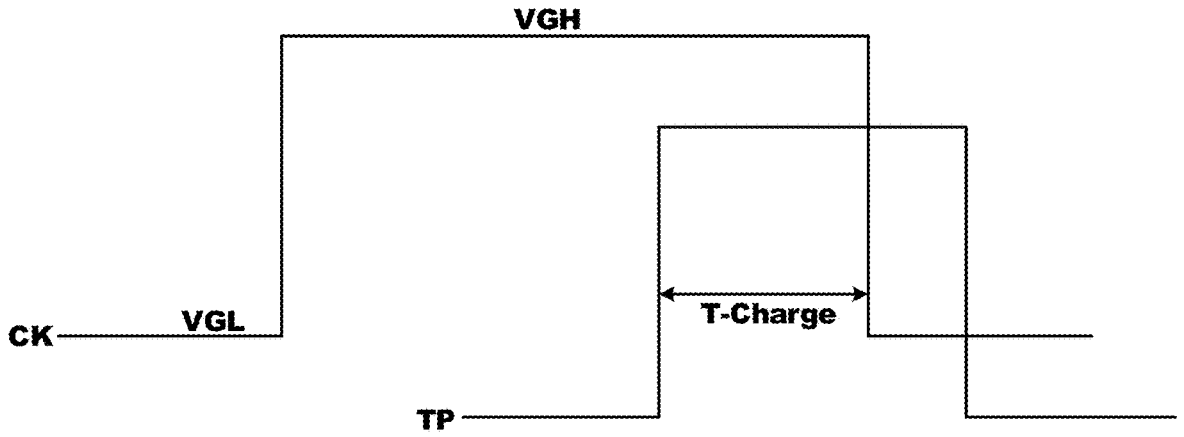
FIG. 4 is a waveform diagram of determining a charging time according to an embodiment of the present disclosure.

As shown in FIG. 4, the method for determining the charging time further comprises: obtaining the scan signal and the data signal received in one frame at each test position; and determining the overlapping time between the pulse of the scan signal and the pulse of the data signal in one frame as the charging time T-Charge.

The scan signal can be obtained by the phase shift of the clock signal CK, and the data signal can be obtained by the phase shift of the data enable signal TP. The high voltage level VGH of the clock signal CK can turn on the corresponding transistor, and the low voltage level VGL of the clock signal CK can turn off the corresponding transistor.

As shown in FIG. 4, the method for determining the charging time further comprises: obtaining the frequency and the phase of the scan signal; obtaining the frequency and the phase of the data signal; and while keeping the frequency of the scan signal and the frequency of the data signal unchanged, changing the phase of the scan signal and/or the frequency of the data signal to adjust the charging time corresponding to the highest luminance in the charging time luminance variance curve to be the optimal charging time.

In this embodiment, the charging time is determined by the time interval between the rising edge of the data enable signal TP and the falling edge of the clock signal CK.

Therefore, by changing the rising edge of the data enable signal TP and/or the falling edge of the clock signal CK, the charging time can be adjusted.

This embodiment provides a charging time determination system. The charging time determination system comprises a display device 100, an obtaining module 200, a detection module 300, and a processor 400.

The display device 100 is configured to display corresponding frame images according to a received grayscale, wherein each of the frame images includes at least one test position. The obtaining module 200 is configured to obtain luminance data corresponding to frame images of at least three grayscales, wherein the luminance data includes a luminance of each test position. The detection module 300 is connected to the display device 100 and is configured to capture a corresponding scan signal and a corresponding data signal in the display device. The processor 400 is electrically connected to the display device 100, the obtaining module 200 and the detection module 300 and is configured to determine a corresponding charging time according to the corresponding scan signal and the corresponding data signal, determine a charging time luminance variance curve according to the luminance of each test potion under the at least three grayscales and the corresponding charging time, and determine a charging time corresponding to a highest luminance in the charging time brightness change curve as an optimal charging time of the display device 100.

In the charging time determination system of this embodiment, the charging time luminance variance curve corresponding to the test position can be obtained through the luminance and charging time of the corresponding test position under at least three grayscales, the charging time luminance variance curves as many as the test positions could be obtained; and then the charging time corresponding to the highest luminance in one or more charging time brightness changing curves is determined as the optimal charging time. The process of determining the optimal charging time is simple, efficient and accurate.

The obtaining module 200 may specifically be one or more cameras of the model CA310. The detection module 300 may specifically be an oscilloscope, which captures a corresponding waveform from the display device 100 and feeds it back to the processor 400. The processor 400 may be a personal computer.

The obtaining module 200 comprises a construction unit, a first obtaining unit, a second obtaining unit, and a third obtaining unit. The construction unit is configured to construct at least three grayscales to include a low grayscale, a medium grayscale, and a high grayscale. The first obtaining unit is used to obtain a reload picture corresponding to the low grayscale. The second obtaining unit is used to obtain a reload picture corresponding to the middle grayscale. The third obtaining unit is configured to obtain a reload picture corresponding to the high grayscale.

The processor 400 comprises a determination unit, a first configuration unit, a second configuration unit, a third configuration unit and a fourth configuration unit. The determination unit is used to determine the luminance and the corresponding charging time of at least three test positions in each frame image. The first configuration unit is configured to configure the area where each frame image is located to include a first area, a second area and a third area distributed in sequence. The second configuration unit is configured to configure the first one of the at least three test positions to be located in the first area. The third configuration unit is configured to configure a second one of the at least three test locations to be located in the second area. The fourth configuration unit is configured to configure a third of the at least three test locations to be located in the third area.

The processor 400 outputs the corresponding grayscale and charging time to the display device 100, and the display device 100 displays the corresponding frame image according to the received grayscale and charging time.

The display device 100, the obtaining module 200, the detection module 300 and the processor 400 can form a closed-loop processing system. In the process of determining the optimum charging time of the display device 100, no human participation is required, which saves manpower, avoids errors resulted from human participations and improves the efficiency of the charging time determination.

The processor 400 writes the optimal charging time into the display device 100 in response to the determination of the optimal charging time and stops the process of determining the optimal charging time for the display device 100.

In this embodiment, after the processor 400 obtains the optimal charging time of the display device 100, the optimal charging time is written into the display device 100, and then the display device 100 will follow the optimal charging time to work. At this time, the optimal charging time of the display device 100 has been determined and written.

The processor 400 controls the display device 100 to display at least three reload pictures corresponding to grayscales, and each grayscale corresponds to a reload picture.

In the process of determining the optimum charging time, the display device 100 displays the reload picture corresponding to the grayscale according to the grayscale output by the processor 400.

The processor 400 obtains a charging time luminance variance curve by simulations according to the luminance and the corresponding charging time of the same test position in the reload pictures corresponding to at least three gray levels.

The processor 400 selects at least three test positions in the same reload picture to obtain a plurality of charging time luminance variance curves and determines that the charging time corresponding to the highest luminance in the plurality of charging time brightness change curves as the optimal charging time of the display device 100.

Figure 6:
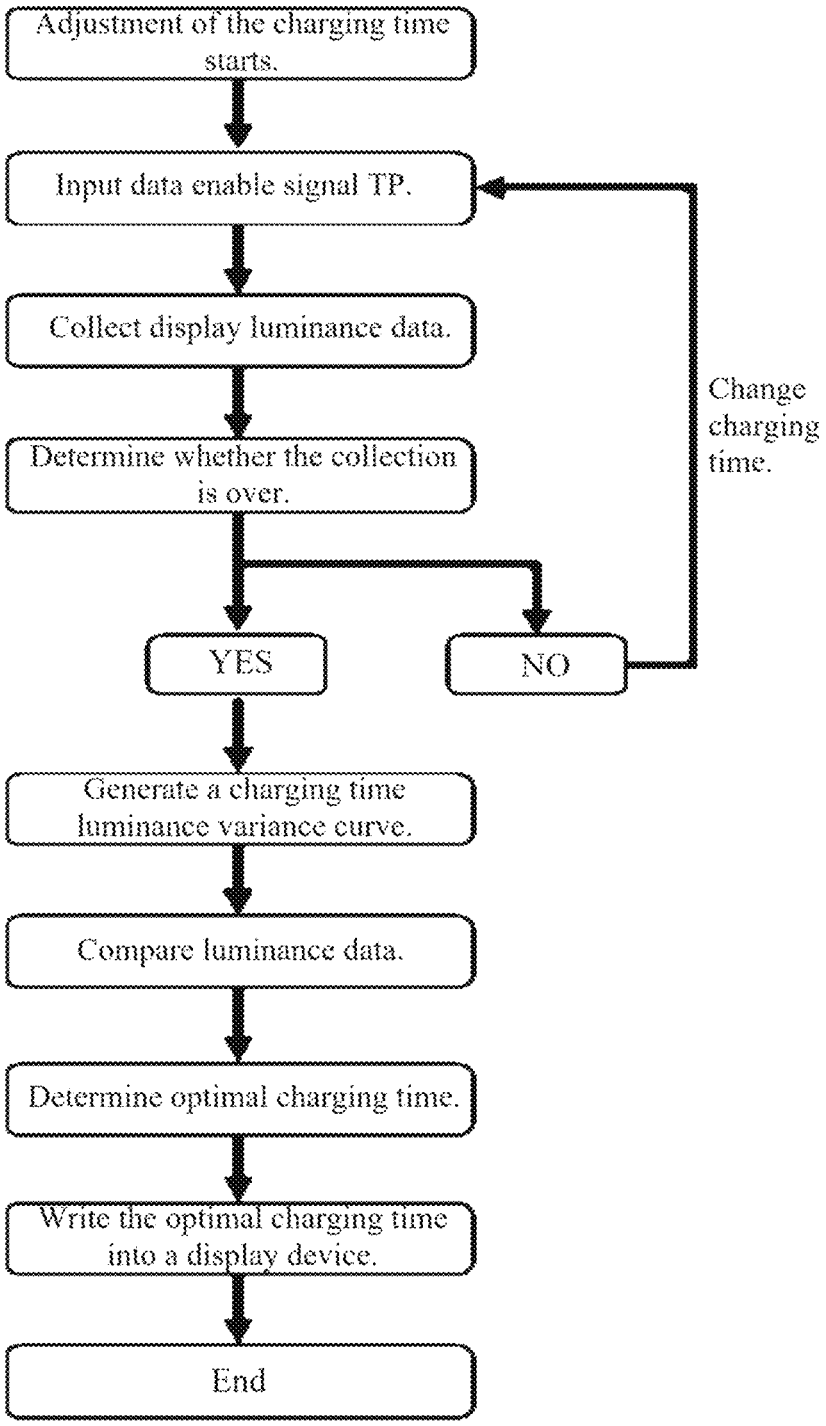
FIG. 6 is a flowchart of a processor according to an embodiment of the present disclosure.

To sum up, the workflow performed by the processor 400 is shown in FIG. 6. The adjustment of the charging time of the display device 100 starts. And then the display device 100 inputs the corresponding data enable signal TP according to the initial charging time, collects the display luminance data from the camera. Then, the display device 100 determines whether the collection is over. That is, the display device 100 determines whether at least one test position and three sets of luminance and the charging time corresponding to each test position have been determined. If not, then the charging time is changed, and then the data enable signal TP corresponding to the adjusted charging time is inputted. If so, the charging time luminance variance curve is generated. By comparing the luminance data (that is, comparing the luminance in the charging time luminance variance curve), the display device 100 could obtain the highest luminance in the charging time luminance variance curve and determine the charging time corresponding to the highest luminance as the optimal charging time. At last, the optimal charging time is written into the display device 100 and the adjustment of the charging time of the display device 100 is completed.

Figure 5:
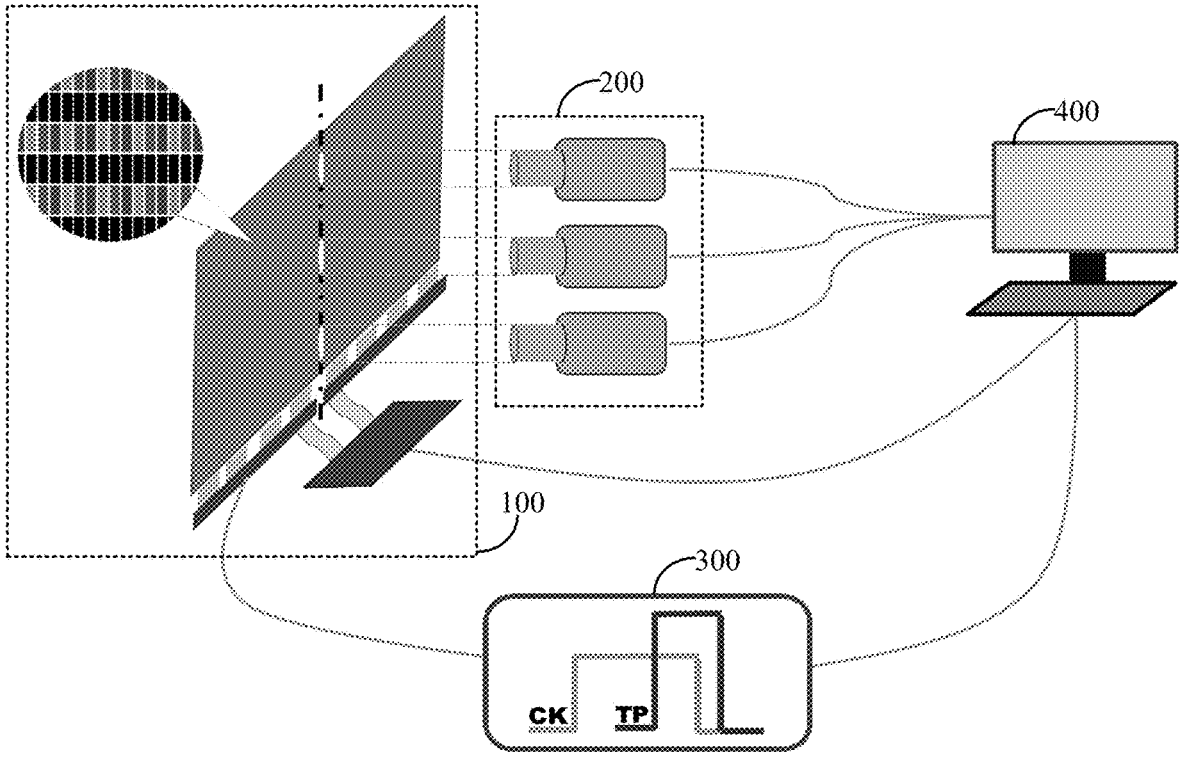
FIG. 5 is a diagram of a charging time determination system according to an embodiment of the present disclosure.
Figure 7:
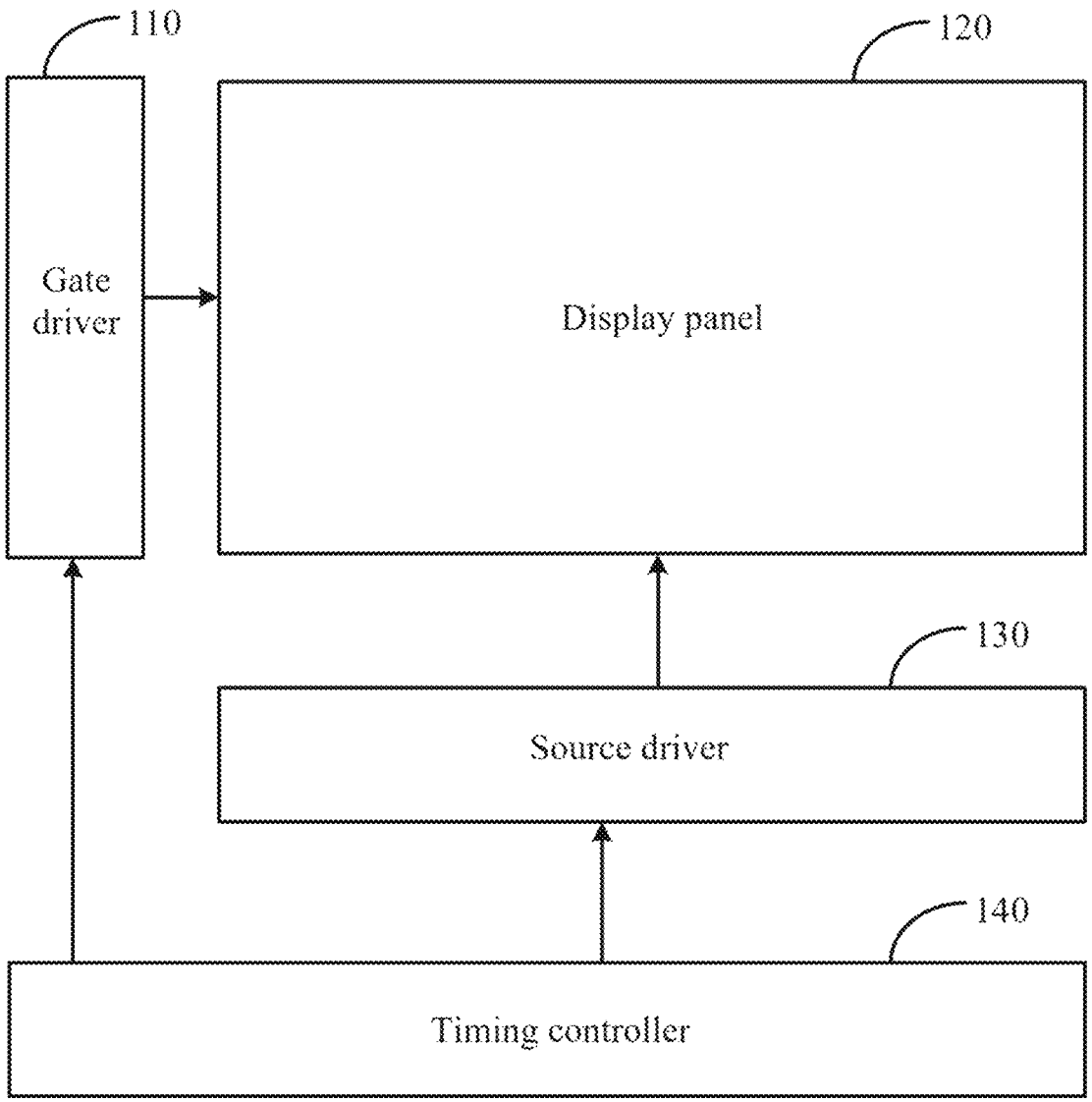
FIG. 7 is a diagram of the display device shown in FIG. 5.

As shown in FIG. 5 and FIG. 7, the display device 100 stores the optimal charging time described in at least one of the aforementioned embodiments.

Since the display device 100 stores the optimal charging time, it can provide better display luminance with a reasonable charging time, which not only reduces the charging time, but also improves the display luminance.

Since the plurality of display devices 100 all store the optimal charging time and the optimal charging time can improve the luminance and chrominance of the display devices 100, the optimal charging time can also improve the image quality difference between different display devices 100 to improve product image quality.

The display device 100 comprises a display panel 120, a gate driver 110, a source driver 130 and a timing controller 140. The display panel 120 is used to display a corresponding frame image. The gate driver 110 is connected to the display panel 120 to provide corresponding scan signals to the display panel 120. The source driver 130 is connected to the display panel 120 to provide corresponding data signals to the display panel 120. The timing controller 140 is connected with the gate driver 110, the source driver 130 and the processor 400 and is used to control the display panel 120 to display a corresponding frame image according to the received grayscale and to adjust the overlapping time between the pulse of the scan signal and the pulse of the data signal in one frame according to the received charging time.

The timing controller 140 modulates the data enable signal according to the charging time. The source driver 130 modulates the data signal according to the data enable signal. The frequency of the data enable signal is the same as the frequency of the data signal, but the phase of the data enable signal is different from the phase of the data signal.

The gate driver 110 outputs a corresponding scan signal according to the received clock signal. The frequency of the clock signal is the same as the frequency of the scan signal, but the phase of the clock signal is different from the phase of the scan signal.

Under the condition that the frequency and phase of the scan signal and the frequency of the data signal remain unchanged, the timing controller 140 controls the source driver 130 to adjust the phase of the data signal through the charging time.

In the above-mentioned embodiments, the description of each embodiment has its own emphasis. For parts that are not described in detail in a certain embodiment, reference may be made to the relevant descriptions of other embodiments.

Although the present invention has been explained by the embodiments shown in the drawings described above, it should be understood to the ordinary skilled person in the art that the invention is not limited to the embodiments, but rather various changes or modifications thereof are possible without departing from the spirit of the invention. Accordingly, the scope of the invention shall be determined only by the appended claims and their equivalents.

What is claimed is:

1. A method of determining a charging time, comprising:

obtaining, by a camera, frame images corresponding to at least three grayscales;

determining, by a processor, a luminance and a corresponding charging time of at least one test position in each of the frame images;

obtaining, by the processor, a charging time luminance variance curve corresponding to the test position according to the luminance of the at least one test position in each of the frame images and the corresponding charging time; and determining, by a processor, the charging time corresponding to a highest luminance in the charging time luminance variance curve as an optimal charging time.

2. The method of claim 1, wherein the step of obtaining the frame images corresponding to the at least three grayscales comprises:

arranging one of the frame images as a reload picture.

3. The method of claim 2, wherein the step of obtaining the frame images corresponding to the at least three grayscales further comprises:

configuring the at least three grayscales to include a low grayscale, a medium grayscale, and a high grayscale;

obtaining a reload picture corresponding to the low grayscale;

obtaining a reload picture corresponding to the middle grayscale; and obtaining a reload picture corresponding to the high grayscale.

4. The method of claim 1, wherein the step of determining the luminance of at least one test position in each frame of images and the corresponding charging time comprises:

determining luminance of at least three test positions in each frame image and a corresponding charging time;

configuring an area where each frame image is located to include a first area, a second area and a third area distributed in sequence;

configuring a first test position of the at least three test locations to be located in the first region;

configuring a second test position of the at least three test locations to be located in the first region; and configuring a third test position of the at least three test locations to be located in the first region.

5. The method of claim 1, wherein the step of determining the luminance of the at least one test position in each of the frame images and the corresponding charging time:

obtaining a scan signal and a data signal received of each test location in one frame;

determining an overlapping time between a pulse of the scan signal and a pulse of the data signal in one frame as the charging time.

6. The method of claim 5, wherein the step of determining the overlapping time between the pulse of the scan signal and the pulse of the data signal in one frame as the charging time comprises:

obtaining a frequency and a phase of the scan signal;

obtaining a frequency and a phase of the data signal;

under a condition that the frequency of the scan signal and the frequency of the data signal are kept unchanged, changing the phase of the scan signal and/or the frequency of the data signal to adjust the charging time corresponding to the highest luminance in the charging time luminance variation curve to be the optimal charging time.

7. A charging time determination system, comprising:

a display device, configured to display corresponding frame images according to a received grayscale, wherein each of the frame images includes at least one test position;

a camera, configured to obtain luminance data corresponding to frame images of at least three grayscales, wherein the luminance data includes a luminance of each test position;

an oscilloscope, connected to the display device, configured to capture a corresponding scan signal and a corresponding data signal in the display device; and a processor, electrically connected to the display device, the camera and the oscilloscope, configured to determine a corresponding charging time according to the corresponding scan signal and the corresponding data signal, determine a charging time luminance variance curve according to the luminance of each test potion under the at least three grayscales and the corresponding charging time, and determine a charging time corresponding to a highest luminance in the charging time luminance variance curve as an optimal charging time of the display device.

8. The charging time determination system of claim 7, wherein the camera is configured to:

construct the at least three grayscales including a low grayscale, a medium grayscale, and a high grayscale;

obtain a reload picture corresponding to the low grayscale;

obtain a reload picture corresponding to the middle grayscale; and obtain a reload picture corresponding to the high grayscale.

9. The charging time determination system of claim 7, wherein the processor executes instructions to:

determine luminance of at least three test positions in each frame image and the corresponding charging time;

configure an area where each frame image is located to include a first area, a second area and a third area distributed in sequence;

configure the first one of the at least three test positions to be located in the first area;

configure a second one of the at least three test positions to be located in the second area; and configure the third one of the at least three test positions to be located in the third area.

10. A display device, storing an optimal charging time determined by the charging time determination system as claimed in claim 7.

* * * * *